US011833407B1

(12) United States Patent
Zywicki

(10) Patent No.: US 11,833,407 B1
(45) Date of Patent: Dec. 5, 2023

(54) SPIN N GRIN

(71) Applicant: David Zywicki, Traverse City, MI (US)

(72) Inventor: David Zywicki, Traverse City, MI (US)

( * ) Notice: Subject to any disclaimer, the term of this patent is extended or adjusted under 35 U.S.C. 154(b) by 0 days.

(21) Appl. No.: 17/744,268

(22) Filed: May 13, 2022

(51) Int. Cl.
*A63B 69/38* (2006.01)

(52) U.S. Cl.
CPC ..... *A63B 69/38* (2013.01)

(58) Field of Classification Search
CPC ..... A63B 69/38
See application file for complete search history.

(56) References Cited

U.S. PATENT DOCUMENTS 2,573,313 A 10/1951 Dayger et al.
4,077,087 A * 3/1978 Mooney ..... B60B 33/021 16/35 R
4,417,730 A * 11/1983 Weiner ..... A63B 69/0091 473/426
5,056,785 A * 10/1991 Robey ..... A63B 69/38 473/459
5,222,732 A * 6/1993 Robey ..... A63B 69/38 473/459
5,431,444 A * 7/1995 Kenealy ..... A01D 34/001 180/19.1
5,685,542 A * 11/1997 Weis ..... A63B 69/0091 588/1
7,435,195 B1 * 10/2008 Calderon ..... A63B 69/0075 473/459
8,333,671 B1 * 12/2012 Wheelbarger ..... A63B 24/0062 473/422
10,065,099 B2 * 9/2018 Dagn ..... A63B 43/008
2003/0118259 A1 * 6/2003 Denner ..... B60B 33/0049 384/416
2013/0053188 A1 * 2/2013 Moore ..... A63B 69/38 473/423
2013/0196794 A1 * 8/2013 Wheelbarger ..... A63F 13/245 473/422
2017/0259153 A1 * 9/2017 Fiedler ..... A63B 69/385

FOREIGN PATENT DOCUMENTS

EP 1728536 A1 * 12/2006 ..... A63B 69/0091
FR 2901485 A1 * 11/2007 ..... A63B 21/153
WO WO-2012096593 A1 * 7/2012 ..... A63B 69/0091
WO WO-2018055582 A1 * 3/2018 ..... A63B 39/00

* cited by examiner

*Primary Examiner* — Raleigh W Chiu
(74) *Attorney, Agent, or Firm* — SANCHELIMA & ASSOCIATES, P.A.; Christian Sanchelima; Jesus Sanchelima

(57) ABSTRACT

A spin n grin including a wheel assembly with a handle assembly and a clamp assembly. The wheel assembly includes a wheel wherein said wheel is attached to a fork wheel which clamps the wheel by a spanned bushing to allow wheel spin and rotates. Handle assembly includes a handle which is attached to the wheel by a tab which is interlocked with the fork wheel allowing rotation of the wheel from the handle. Clamp assembly includes a first clamp and a second clamp wherein the handle is placed through one of the clamps to allow slide and adjust clamp as required. Wheel is attached to any object by clamp allowing a user to practice any paddle sport by kicking the wheel.

1 Claim, 4 Drawing Sheets

SPIN N GRIN

BACKGROUND OF THE INVENTION

1. Field of the Invention

The present invention relates to a spin n grin and, more particularly, to a spin n grin that a system for practicing and simulate a paddle sport by a wheel that swivel 360 grades which simulates the spinning of the ball.

2. Description of the Related Art

Several designs for a spin n grin have been designed in the past. None of them, however, include a wheel that can be attached by an enlarged with a clamp that swivel for practicing any paddle sport.

Applicant believes that a related reference corresponds to U.S. Pat. No. 2,573,313 issued for a base upon which is supported a rod or shaft in a substantially vertical position. Applicant believes that another related reference corresponds to U.S. Pat. No. 5,056,785 issued for a tennis stroke practice device wherein a shaft having a plurality of angular bends intermediate its end is provided with a handle attached to one of its ends and a wheel rotatably attached to its other hand. None of these references, however, teach of a device to teach sportsmen who use paddles how to spin a ball, read ball spin and enhance muscle memory. The device includes a clamp to attach the device to a support at a desired level. A paddle may then be used to rotate an attached wheel to simulate the actions utilized while playing any sport that uses a paddle and ball. The wheel can swivel 360 to mimic what occurs when a ball is played. The device is useful for anyone desiring to improve their sports performance.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a system with a clamp that can easily be attached to any object.

It is another object of this invention to provide a wheel that swivels depending on the angle required for practicing a paddle sport.

It is still another object of the present invention to provide a system for teaching the movement of spinning by attaching a wheel by a clamp.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
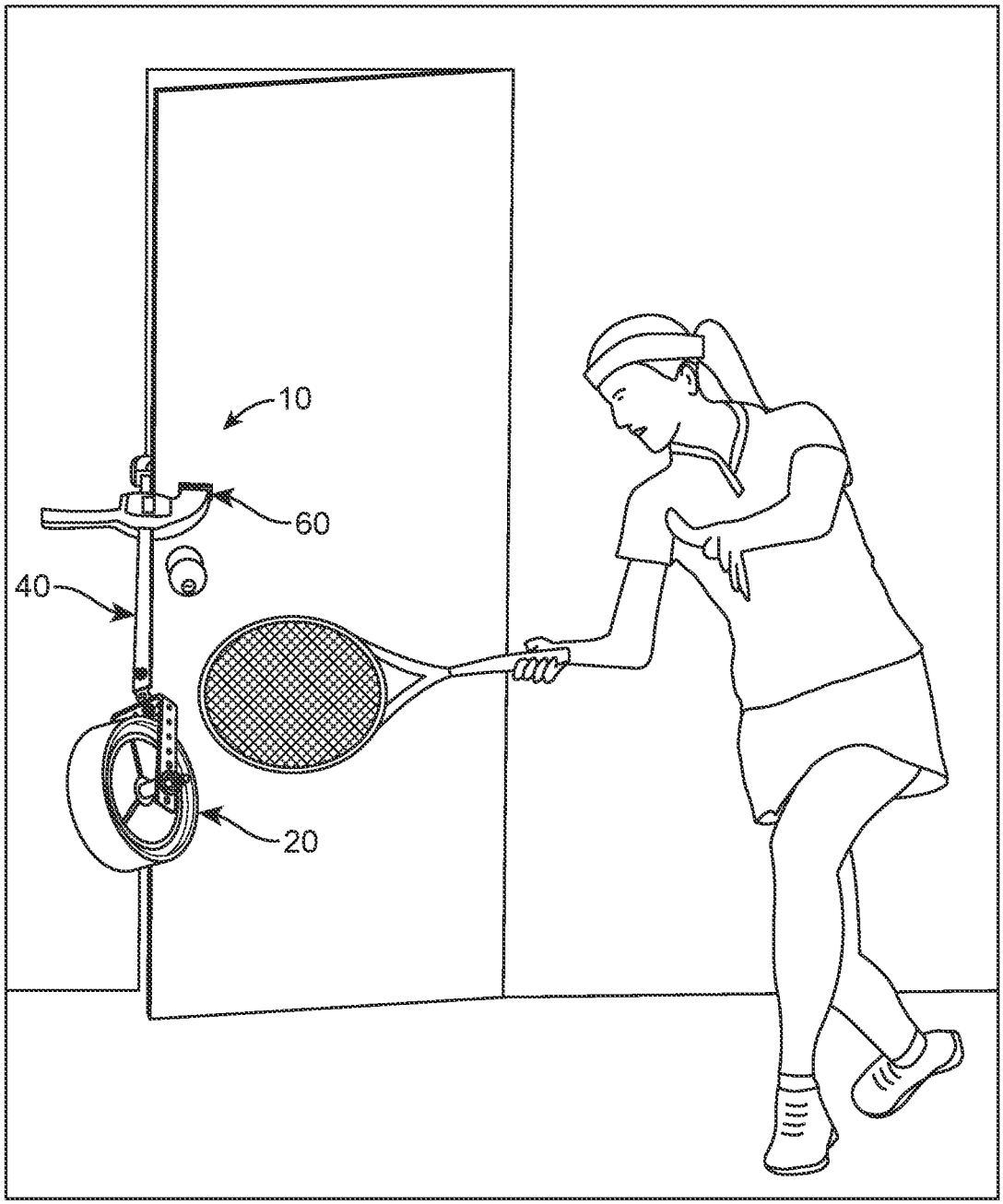
FIG. 1 represents an operational view of the present invention 10 wherein a user is practicing a sport using a paddle to simulate a ball spinning of the invention 10.

Referring now to the drawings, where the present invention is generally referred to with numeral 10, it can be observed that it basically includes a wheel assembly 20, a handle assembly 40 and a clamp assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
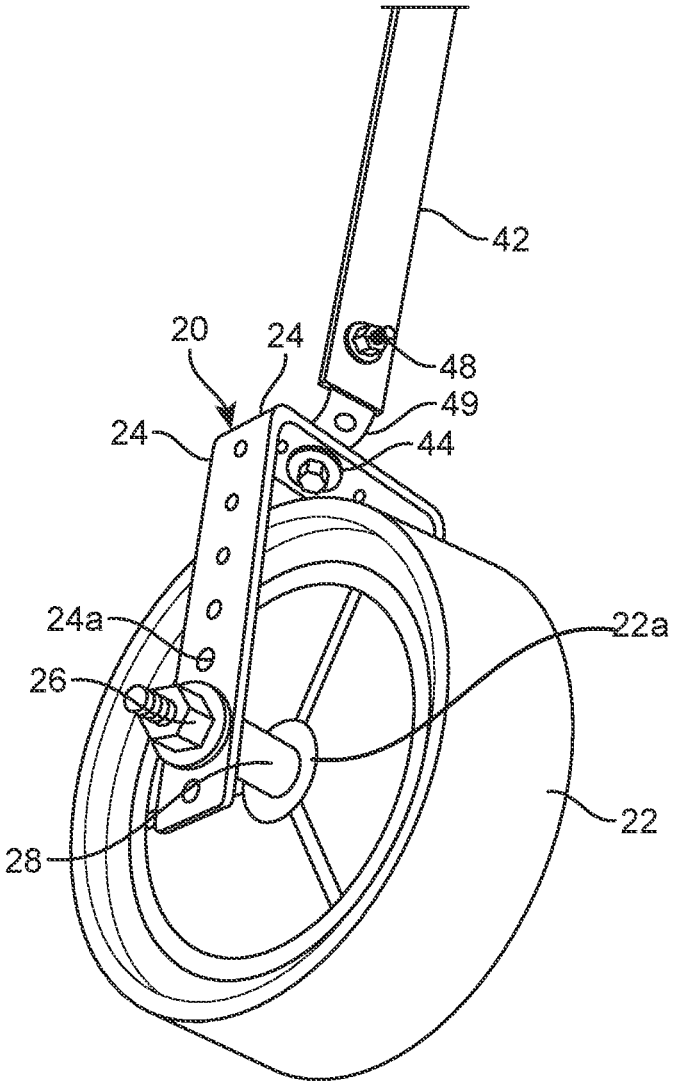
FIG. 2 shows a perspective side view of the wheel assembly 20 wherein is shown a caster 24 (with openings 24*a*) attached to a wheel 22 by axle nuts 26 and spanner bushing 28.

The wheel assembly 20 includes a wheel 22, a bolt circle 22*a*, a fork wheel 24, openings 24*a*, an axle nut 26, a spanner bushing 28 and a bolt axle 29. It is to be understood that wheel may have a cylindrical body as best observed in FIG. 1. Nevertheless, in another embodiment wheel 22 may have a spherical body. In a suitable embodiment wheel may be attached to the fork wheel 24 by the bolt circle 22*a* and the spanner bushing 28. In a suitable embodiment, wheel 22 may be made of a rigid plastic material. Nevertheless, other materials like metal, steel, wood, polymers, rigid rubber, aluminum, carbon fiber, or any other variation thereof may be suitable for wheel 22. Wheel 22 may be configured to spin and rotate by fork wheel 24 when applying force thereof. In a suitable embodiment bolt circle 22*a* may be made of a rigid plastic material as wheel 22 may be made of. Bolt circle 22*a* may be suitable to have a form that conforms with the body of wheel 22. In one embodiment bolt circle 22*a* may be concentrically attached to the center of the wheel 22. In a preferred embodiment bolt circle 22*a* may be configured to have attached the spanner bushing 28 through in. In a suitable embodiment, fork wheel 24 may have a square body wherein the internal sides thereof clamp the sides of the wheel 22. In a suitable embodiment fork wheel 24 and openings 24*a* may be made of a metal material. Nevertheless, in other embodiments fork wheel 24 and openings 24*a* may be made of a steel material, plastic material, wood material, polymer material, aluminum material, stainless steel material, carbon fiber material or the like. Fork wheel 24 may be configured to fasten wheel 22 to handle assembly 40. Fork wheel 24 may include openings 24*a* which are placed along the sides and top thereof as best observed in FIG. 2. Openings 24*a* may have a circular body. Nevertheless, other shapes like octagonal, hexagonal, pentagonal, square, oval, or any other variation may be suitable for openings 24*a*. In a preferred embodiment, openings 24*a* may be suitable for inserting the bolt axle through.

Figure 4:
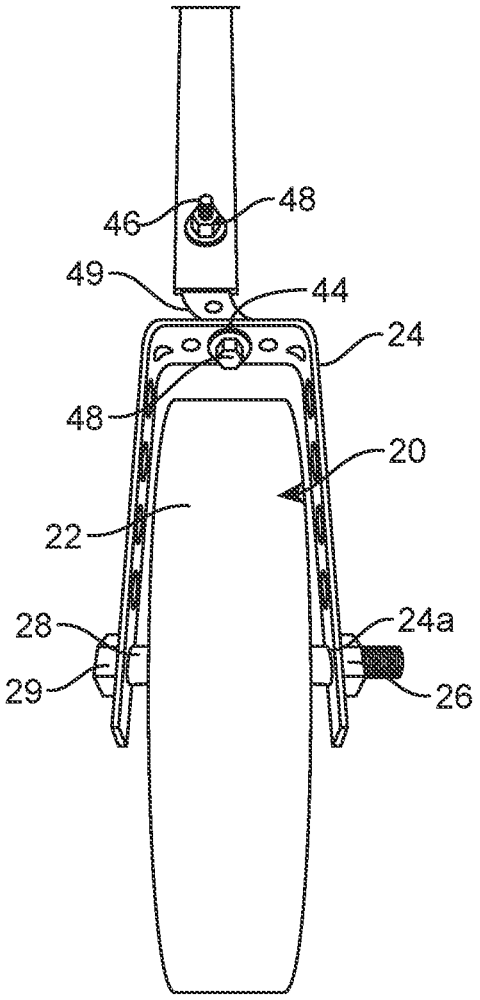
FIG. 4 is a representation of a perspective front view the body assembly 40 wherein body 42 is attached to wheel assembly 20 by a tab 49.

As best observed in FIG. 4 at least two of the openings 24*a* may be concentrically placed with the bolt circle 22*a* of the wheel 22. In a suitable embodiment, spanner bushing 28 may be inserted to the bolt circle 22*a*. In a preferred embodiment, spanner bushing 28, axle nut 26 and bolt axle 29 may be suitable to be made of a metal material. Nevertheless, other materials like steel, plastic, wood, stainless steel, iron, or any other variation thereof. Spanner bushing 28 may be configured to allow wheel 22 to spin. Spanner bushing 28 may be suitable to have a body that conforms with the body of the bolt circle 22*a*. It is to be considered that axle nut 26 and belt axle 28 may be configured to fasten wheel 22 to the fork wheel 24. Belt axle 28 may be inserted through the spanner bushing 28 when is concentrically placed with at least two of the openings 24*a* of the fork wheel 24 by the one side of the spanner bushing 28 as shown in FIG. 4. Belt axle 28 may have a cylindrical body with a thread portion wherein axle nut 26 may be screwed thereof when belt axle 28 is inserted through one of the openings 24*a* and the spanner bushing 28 which is attached through the bolt circle 22*a*. Axle nut 26 may be concentrically attached to one of the openings 24*a* which is opposite to the opening that belt axle 28 inserted. In a suitable embodiment, axle nut 26 may have a hollow body that conforms with the body of the belt axle 28 when screwed thereof.

The handle assembly 40 includes a handle 42, a swivel fastener 44, a second bolt axle 46, a second axle nut 48, a tab 49 and second openings 49*a*. In one embodiment handle 42 may have an enlarged rectangular shape. Nevertheless, in other embodiments handle 42 may have a box section body, a tube body, a telescopic body, a rod body or any other variation thereof. Handle 42 may be configured to be attached to the wheel 22 by a tab 49. In one embodiment handle 42, swivel fastener 44, second bolt axle 46, second axle nut 48, and tab 49 may be made of a metal material. Nevertheless, other materials like steel, carbon fiber, stainless steel, aluminum, rigid plastic, or any other variation thereof may be suitable for handle 42, swivel fastener 44, second bolt axle 46, second axle nut 48, and tab 49. In one embodiment swivel fastener 44 may have a hollow circular body that conforms with one of the openings 24*a* that is located on a top surface of the fork wheel 24 when is concentrically located thereof. Swivel fastener 44 may allow the fork wheel 24 to rotate a full rotation. The second bolt axle 46 may be inserted to the fork wheel 22 to a top surface thereof through one of the openings 24*a*. Second axle nut 48 may be configured to be inserted through the second bolt axle 46 when inserted through one of the openings 24*a* of the tab 29. Second axle nut 48 and second bolt axle 46 may allow fastening the wheel assembly 20 to the handle assembly by the tab 49.

Figure 3:
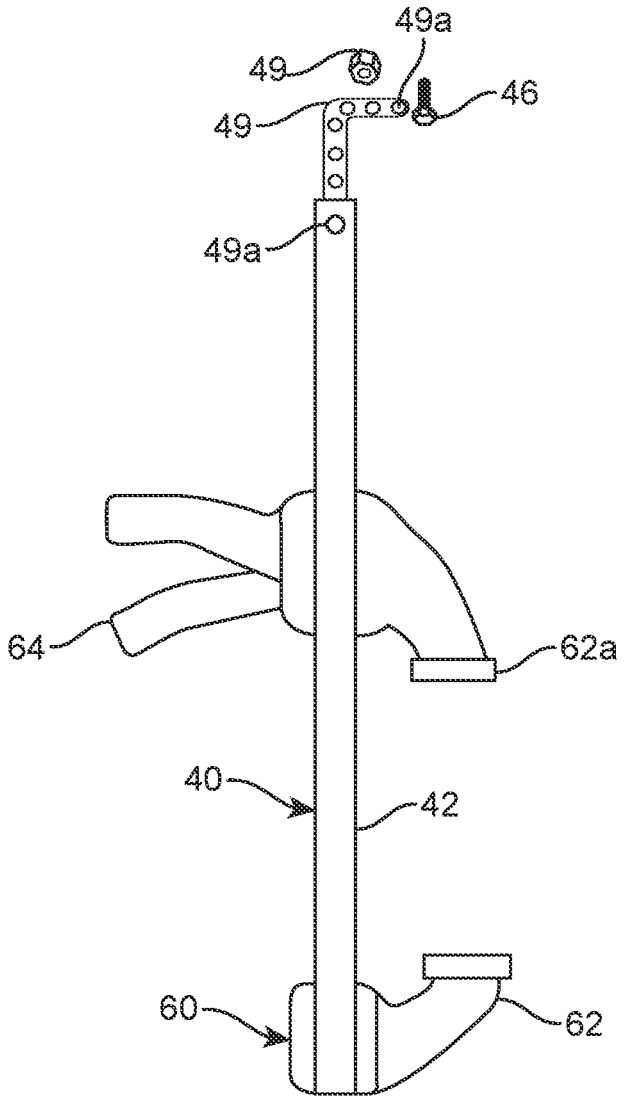
FIG. 3 illustrates a bottom view of the clamp assembly 60 wherein the clamp 62 is attached to the handle assembly 40.

The clamp assembly 60 includes a first clamp 62 with a second clamp 62*a* and a clamp adjustment 64. In a suitable embodiment first clamp 62, second clamp 62*a* and clamp adjustment 64 may be made of a plastic material. Nevertheless, other materials like metal, wood, polymer, steel, carbon fiber, iron or any other variation thereof may be suitable for first clamp 62 with a second clamp 62*a* and a clamp adjustment 64. In a preferred embodiment, first clamp 62 with a second clamp 62*a* and a clamp adjustment 64 may be configured to fasten the handle 42 allowing to attach the wheel assembly 20. First clamp 62 may be attached to one ending of the handle 42 as observed in FIG. 3. First clamp 62 may have a curved shape. In one embodiment, the second clamp 62*a* may have a curved shape. Second clamp 62*a* may have attached the clamp adjustment 64 on the side 64 which adjusts wheel assembly 20 when attached to an object.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A practice device, consisting of:

a wheel assembly including a wheel, a bolt circle, an axle nut, a spanner bushing, and a bolt axle, said wheel includes a rotatory fork wheel clamped thereon by said spanner bushing placed through the bolt circle of the wheel which allows wheel to rotate 360°, said fork wheel having openings said bolt axle is placed through said spanner bushing when inserted in one of said openings of the fork wheel and fastened with the axle nut placed opposite to the bolt axle in one of the openings of the fork wheel which interlocks wheel with fork wheel;

a handle assembly including a handle, a swivel fastener, and second openings, said handle has a tab attached to an ending thereof by a second bolt axle placed through one of the second openings of the handle and a second bolt nut screwed thereof, said tab allows the wheel and handle to interlock, said swivel fastener is attached concentrically to an top internal opening of said openings of the fork wheel with the second bolt axle and the second axle nut wherein said swivel fastener allows wheel to rotates, said tab allows to interlock said fork wheel with the handle to fasten wheel by the clamp; and a clamp assembly including a clamp, said clamp is composed by a first clamp and a second clamp wherein the first clamp is attached to an ending of the handle and second clamp is mounted on the handle such a way the second clamp slides through the handle and can be adjusted by a clamp adjustment.

* * * * *